US008579160B2

(12) United States Patent
McMichael et al.

(10) Patent No.: US 8,579,160 B2
(45) Date of Patent: Nov. 12, 2013

(54) VALVE ACTUATOR

(75) Inventors: Jonathan R. McMichael, North Canton, OH (US); Steven R. Sinders, Mooresville, IN (US)

(73) Assignee: Graco Minnesota, Inc., Minneapolis, MN (US)

( * ) Notice: Subject to any disclaimer, the term of this patent is extended or adjusted under 35 U.S.C. 154(b) by 15 days.

(21) Appl. No.: 13/511,259

(22) PCT Filed: Nov. 23, 2010

(86) PCT No.: PCT/US2010/003028
§ 371 (c)(1), (2), (4) Date: May 22, 2012

(87) PCT Pub. No.: WO2011/062642
PCT Pub. Date: May 26, 2011

(65) Prior Publication Data

US 2012/0273520 A1 Nov. 1, 2012

Related U.S. Application Data

(60) Provisional application No. 61/263,487, filed on Nov. 23, 2009.

(51) Int. Cl.
*B67D 7/78* (2010.01)

(52) U.S. Cl.
USPC ..... 222/145.1; 239/526; 239/527; 239/528; 222/132

(58) Field of Classification Search
USPC ..... 222/132, 135, 136, 137, 145.5, 145.7, 222/145.6, 145.1, 470, 472, 473, 474, 134, 222/145.8; 74/156, 522; 239/61, 62, 270, 239/290, 398, 527, 526, 528; 251/128, 213, 251/215, 231, 232, 279, 318, 319, 320, 321
See application file for complete search history.

(56) References Cited

U.S. PATENT DOCUMENTS 1,268,232 A * 6/1918 Furman ..... 239/415
1,662,042 A * 3/1928 Birkenmaier ..... 239/528
(Continued)

FOREIGN PATENT DOCUMENTS

WO WO 93/03860 A1 3/1993

OTHER PUBLICATIONS

International Search Report and Written Opinion from International Application Serial No. PCT/US2010/003028, dated Aug. 30, 2011, 9 pages.

*Primary Examiner* — Kevin P Shaver
*Assistant Examiner* — Michael J Melaragno
(74) *Attorney, Agent, or Firm* — Kinney & Lange, P.A.

(57) ABSTRACT

A dispensing gun has a gun body, a first component inlet, a second component inlet, a dispense head, a first valve, a second valve, a clamp, and a trigger. The component inlets are attached to the gun body for receiving components. The dispense head is for dispensing the components. The valves are attached to the gun body and there are valve stems for controlling the dispensing of the components. The clamp has an upper portion and a lower portion, with the first and second valve stems positioned in between the upper and lower portions. The two portions are attached such that the first and second valve stems move with movement of the valve actuator in a direction parallel to the axes of the valve stems. The trigger is attached to the gun body and controls movement of the clamp.

20 Claims, 4 Drawing Sheets

(56) References Cited

U.S. PATENT DOCUMENTS

| | | | | | |
|---|---|---|---|---|---|
| 3,330,484 | A | * | 7/1967 | Johnson et al. | 239/414 |
| 3,417,923 | A | * | 12/1968 | Carlson | 239/112 |
| 4,083,474 | A | * | 4/1978 | Waite et al. | 222/145.7 |
| 4,821,927 | A | | 4/1989 | Paulsen et al. | |
| 5,004,125 | A | * | 4/1991 | Standlick | 222/23 |
| 5,104,006 | A | | 4/1992 | Brown | |
| D649,221 | S | * | 11/2011 | Sinders et al. | D23/226 |
| 2004/0226965 | A1 | | 11/2004 | Rueschhoff et al. | |
| 2005/0189445 | A1 | * | 9/2005 | Hartle et al. | 239/691 |
| 2006/0118661 | A1 | * | 6/2006 | Hartle et al. | 239/691 |

* cited by examiner

VALVE ACTUATOR

CROSS-REFERENCE TO RELATED APPLICATION(S)

This application claims priority under 35 U.S.C. §120 to U.S. provisional application Ser. No. 61/263,487, entitled "VALVE ACTUATOR," filed Nov. 23, 2009 by inventors Steven Sinders and Jonathan McMichael, the contents of which are incorporated by this reference.

This application claims priority under 35 U.S.C. §119 to PCT application Serial No. PCT/US2010/003,028, entitled "VALVE ACTUATOR," filed Nov. 23, 2010 by inventors Steven Sinders and Jonathan McMichael, the contents of which are incorporated by this reference.

BACKGROUND

The present invention relates to plural component dispensing devices, and, more particularly, to actuation of valves in a plural component dispensing gun.

Typically, plural components of the type relating to the present invention comprise a resin or gel coat component which is chemically inert in isolated form and a catalyst component which is also chemically inert in isolated form. When the two components are combined, an immediate chemical reaction begins taking place that results in the cross-linking, curing, and solidification of the mixture. In order for the optimal final product to result, the two components must be dispensed in the proper ratio. Such a ratio must also be maintained during the commencement and cessation of dispensing. Because the two components react and solidify when mixed, they must be metered separately with separate valves. However, precisely actuating the valves to open the appropriate amount at the same time can be difficult.

SUMMARY

According to one embodiment of the present invention, a dispensing gun has a gun body, a first component inlet, a second component inlet, a dispense head, a first valve, a second valve, a clamp, and a trigger. The first component inlet is attached to the gun body for receiving a first component, and the second component inlet is attached to the gun body for receiving a second component. The dispense head is for dispensing the first and second components. The first valve is attached to the gun body and has a first valve stem for controlling the dispensing of the first component. The second valve is attached to the gun body and has a second valve stem for controlling the dispensing of the second component that is parallel to the first valve stem. The clamp has an upper portion and a lower portion, with the first valve stem and the second valve stem positioned in between the upper portion and the lower portion. The upper portion is attached to the lower portion such that the first valve stem and the second valve stem move with movement of the valve actuator in a direction parallel to the axes of the valve stems. The trigger is attached to the gun body and controls movement of the clamp.

In another embodiment, a valve actuation system has a first valve, a second valve, and a valve actuator. The first valve has a first valve stem for controlling the dispensing of a first component. The second valve has a second valve stem for controlling the dispensing of a second component that is parallel to the first valve stem. The valve actuator is clamped to the valve stems to open the valves by jointly moving the valve stems. The valve actuator has two slots for attaching the valve actuator to the valve stems, with the slots corresponding to the shape of the valve stems. The valve actuator also has two parallel holes for receiving set screws.

In another embodiment, a valve assembly has a trigger, a first valve, a second valve, a valve actuator, a first push pin, and a second push pin. The trigger has a first cam and a second cam. The first valve has a first valve stem for controlling the dispensing of a first component. The second valve has a second valve stem for controlling the dispensing of a second component that is parallel to the first valve stem. The valve actuator has a first portion having slots for the valve stems and a second portion that clamps the valve stems in the slots. The parallel push pins contact the cams and the valve actuator.

DETAILED DESCRIPTION

Figure 1:
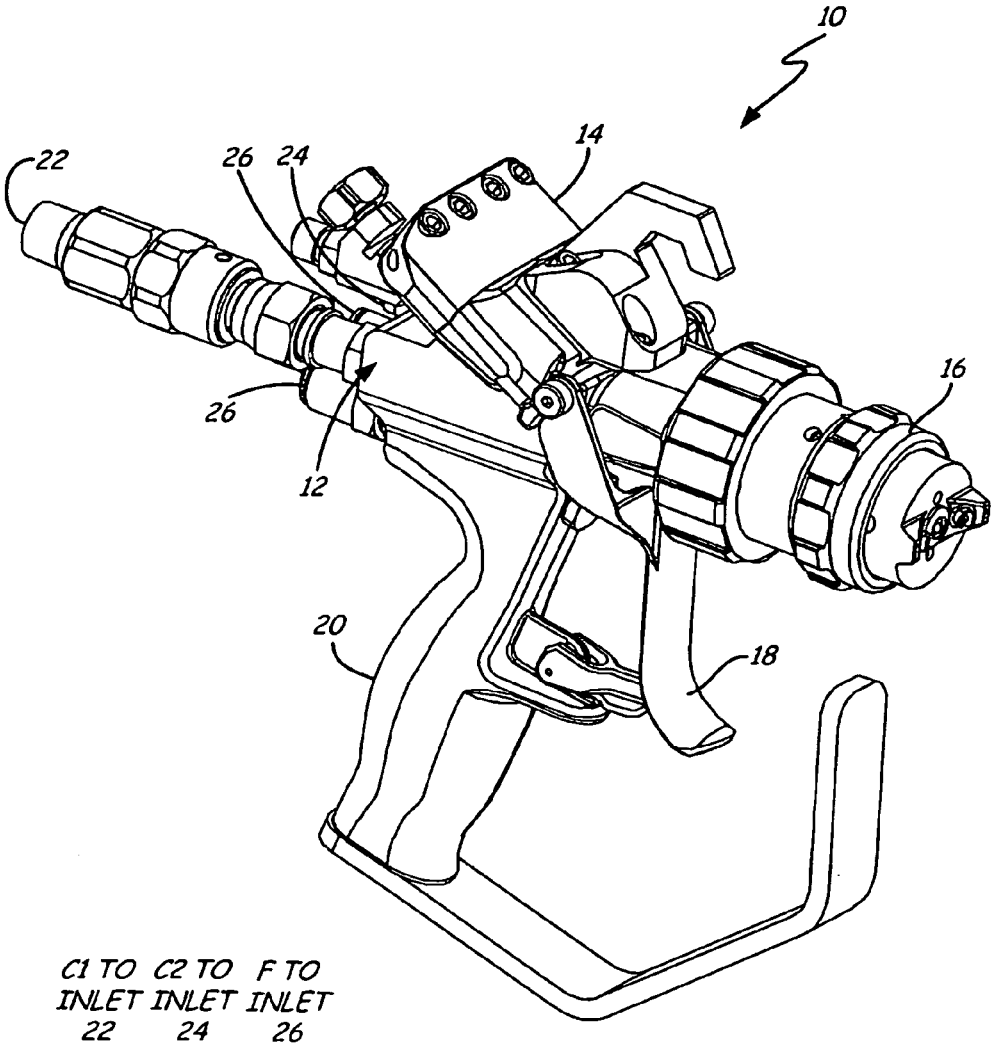
FIG. 1 is a perspective view of a dispensing gun having a valve actuator.
Figure 1:
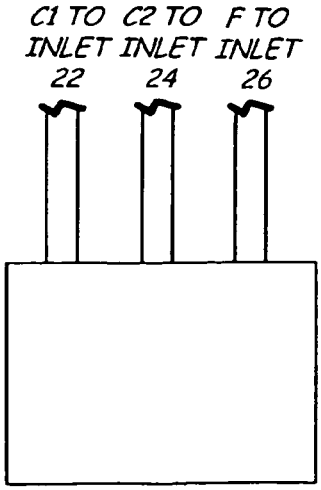

In FIG. 1, a perspective view of dispensing gun 10 is shown. Shown in FIG. 1 are dispensing gun 10, gun body 12, valve actuator 14, dispense head 16, trigger 18, handle 20, first component inlet 22, second component inlet 24, fluid inlet 26, metering system 28, first component C1, second component C2, and fluid F.

Dispensing gun 10 includes gun body 12, dispense head 16, and handle 20. Dispense head 16 is attached to the front of gun body 12 while handle 20 is attached to the bottom of gun body 12. Trigger 18 is rotatably connected to gun body 12, and valve actuator 14 is positioned at the top of gun body 12. Valve actuator 14 is attached to three valves that are attached to the top of gun body 12 (as shown later in FIG. 4).

Figure 4:
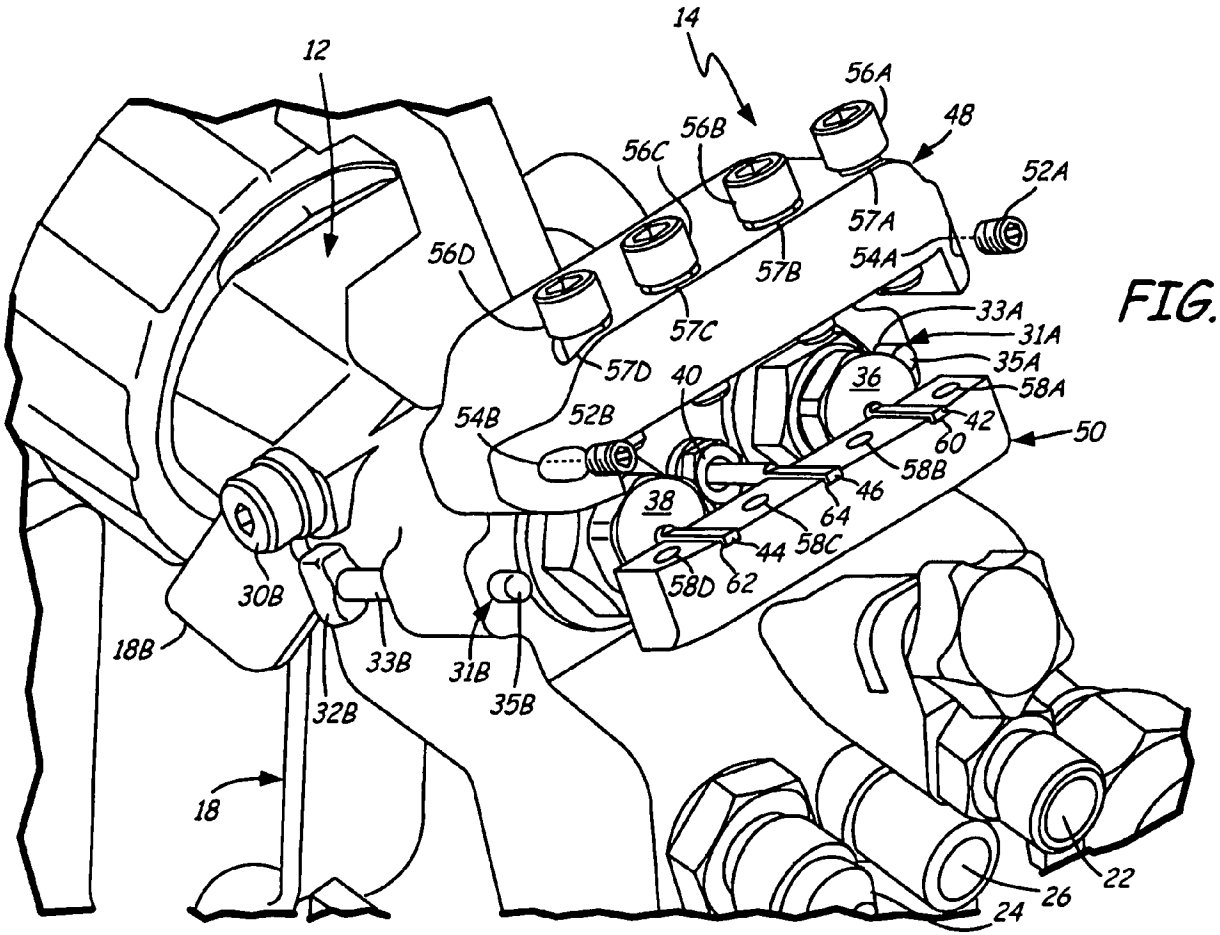
FIG. 4 is an exploded view of the valve actuator showing valves with valve stems.

At the rear of gun body 12 are first component inlet 22, second component inlet 24, and fluid inlet 26 (inlets 22, 24, and 26 are also shown in FIG. 4 for clarity). Metering system 28 is fluidly connected to dispensing gun 10 through first component inlet 22, second component inlet 24, and fluid inlet 26. Metering system 28 pressurizes and provides first component C1, second component C2, and fluid F to dispensing gun 10.

Dispensing gun 10 operates when a user pulls trigger 18. This moves valve actuator 14, which is attached to three valves (as shown later in FIG. 4). When the three valves are opened by valve actuator 14, first component C1, second component C2, and fluid F travel through dispensing gun 10 and are dispensed out of dispense head 16. Dispense head 16 is configured such that first component C1 and second component C2 collide and are mixed after leaving dispense head 16, with the aid of fluid F. Pressurized fluid F can be any suitable fluid, and in the illustrated embodiment, fluid F is pressurized air.

The components and configuration of dispensing gun 10 as shown in FIG. 1 allow for first component C1 and second component C2 to be dispensed and mixed in order to start a solidifying chemical reaction. Valve actuator 14 coordinates opening of the valves such that first component C1 and second component C2 are dispensed in a proper ratio. Depicted in FIG. 1 is one embodiment of the present invention, to which there are alternative embodiments. For example, dispense head 16 can internally mix first component C1 and second component C2. In such an embodiment, fluid F can be used to shape the mixture during dispensing.

Figure 2A:
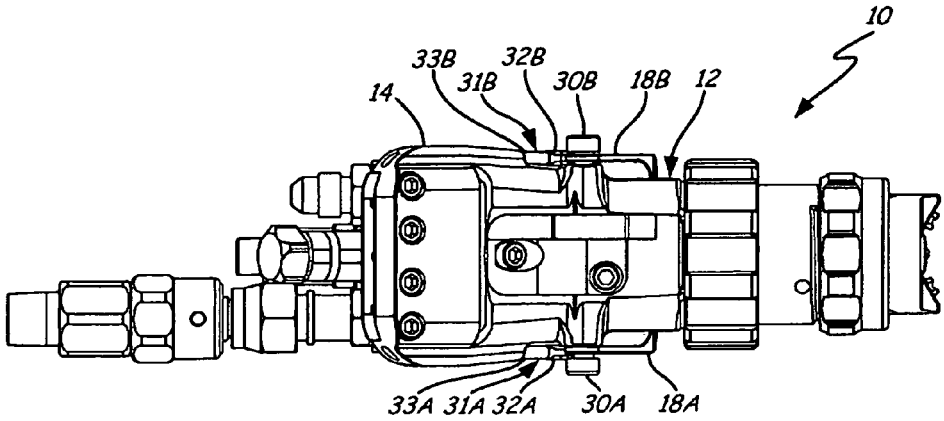
FIG. 2A is a top view of the dispensing gun of FIG. 1 with the valve actuator in a closed position.
Figure 2B:
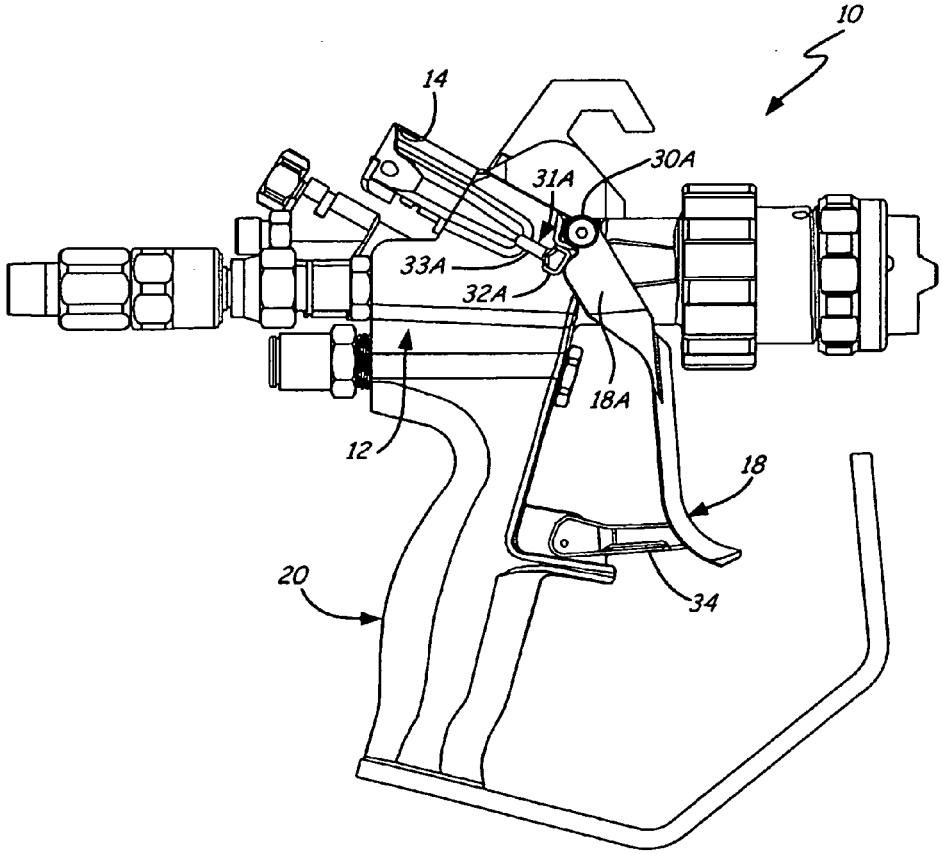
FIG. 2B is a side view of the dispensing gun of FIG. 1 with the valve actuator in the closed position.

In FIG. 2A, a top view of dispensing gun 10 is shown. In FIG. 2B, a side view of dispensing gun 10 is shown. Shown in FIGS. 2A-2B are dispensing gun 10, gun body 12, valve actuator 14, trigger 18, trigger arms 18A-18B handle 20, trigger pivots 30A-30B, push pins 31A-31B (having pin heads 32A-32B and pin shafts 33A-33B, respectively), and trigger lock 34. The discussion of FIGS. 2A-2B will occur simultaneously.

As stated previously, trigger 18 is rotatably connected to gun body 12. Specifically, trigger 18 rotates on trigger pivots 30A-30B, with trigger pivot 30A attached to one side of gun body 12 and trigger pivot 30B attached to the opposite side. Trigger 18 has trigger arms 18A-18B, with trigger 18 coming from underneath gun body 12 and trigger arm 18A wrapping around one side of gun body 12 to rotatably connect with trigger pivot 30A and trigger arm 18B wrapping around the opposite side to rotatably connect with trigger pivot 30B. Near the bottom of trigger 18 is trigger lock 34. Trigger lock 34 is rotatably connected to handle 20, and is shown in a downward position. In this position, trigger lock 34 prevents the rotation of trigger 18.

Near the top of trigger 18 at trigger arms 18A-18B, below trigger pivots 30A-30B are two cam surfaces. These cams contact push pins 31A-31B respectively, with push pin 31A on one side of gun body 12 and push pin 31B on the opposite side. Push pin 31A has pin head 32A and pin shaft 33A while push pin 31B has pin head 32B and pin shaft 33B. Push pins 31A-31B are substantially parallel to each other and are slidably positioned in sockets in gun body 12 at pin shafts 33A-33B, respectively. Furthermore, push pins 31A-31B are substantially coplanar along pin shafts 33A-33B. Pin head 32A contacts the cam on trigger arm 18A while pin head 32B contacts the cam on trigger arm 18B. Each push pin 31A-31B contacts valve actuator 14 at pin ball 35A-35B (as shown later in FIG. 4), respectively, with pin balls 35A-35B being at the distal ends of pin shafts 33A-33B from pin heads 32A-32B, respectively. Thereby, push pins 31A-31B can transmit force from trigger 18 to valve actuator 14. Valve actuator 14 is positioned at the top of gun body 12. Valve actuator 14 is in a closed position in FIGS. 2A-2B, as evidenced by valve actuator 14 being near to gun body 12.

The components and configuration of dispensing gun 10 as shown in FIG. 1 allow trigger 18 to rotate and be mechanically linked to valve actuator 14. The details of how trigger 18 moves valve actuator 14 will be described later with reference to FIG. 3.

Figure 3:
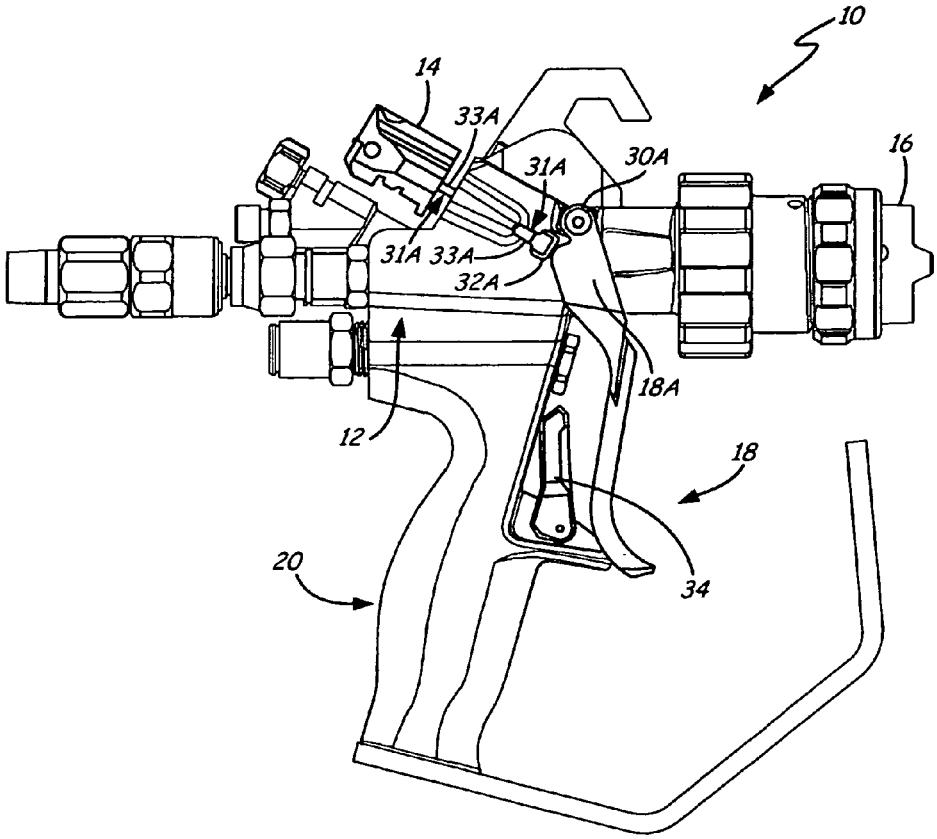
FIG. 3 is a side view of the dispensing gun of FIG. 1 with the valve actuator in an open position.

In FIG. 3, a side view of dispensing gun 10 is shown. Shown in FIG. 3 are dispensing gun 10, gun body 12, valve actuator 14, dispense head 16, trigger 18, trigger arm 18A, handle 20, trigger pivot 30A, push pin 31A, pin head 32A, pin shaft 33A, and trigger lock 34. The relationships between the components of dispensing gun 10 are as previously recited with FIGS. 1-2B. However, the positions of some of the components have changed.

Specifically, trigger lock 34 has been rotated upward, allowing trigger 18 to be pivoted back towards handle 20. Because trigger arm 18A has a cam surface that can slide along pin head 32A, such pivoting slides push pin 31A up and back, also forcing valve actuator 14 up and back. Although it is not shown, the same motion occurs on the other side of dispensing gun 10. Specifically, trigger arm 18B causes push pin 31B to move in a parallel direction to push pin 31A due to trigger 18 being pivoted. In the illustrated embodiment, valve actuator is an open position away from gun body 12.

The components and configuration of dispensing gun 10 as shown in FIG. 3 allow for valve actuator 14 to be moved by pulling trigger 18. As will be described in greater detail with FIG. 4, such movement of the valve actuator coordinates movement of the three valves. This allows first component C1, second component C2, and fluid F to be dispensed from dispense head 16 in a desired ratio.

In FIG. 4, an exploded view of valve actuator 14 is shown. Shown in FIG. 4 are gun body 12, valve actuator 14, trigger 18, trigger arm 18B, trigger pivot 30B, push pins 31A-31B, pin head 32B, pin shafts 33A-33B, pin balls 35A-35B, first valve 36, second valve 38, third valve 40, first valve stem 42, second valve stem 44, third valve stem 46, upper actuator portion 48, lower actuator portion 50, set screws 52A-52B, set screw holes 54A-54B, actuator screws 56A-56D, upper actuator holes 57A-57D, lower actuator holes 58A-58D, first stem slot 60, second stem slot 62, and third stem slot 64.

As stated previously, trigger arm 18B (and trigger arm 18A, not shown) of trigger 18 is rotatably connected to gun body 12 at trigger pivot 30B. Trigger arm 18B has a cam surface that is in contact with push pin 31B at pin head 32B. Pin shaft 33B of push pin 31B is slidably positioned in an aperture in gun body 12. At the distal end of pin shaft 33B from pin head 32B is pin ball 35B. Pin ball 35A of push pin 31A is shown on the opposite side of gun body 12.

First valve 36, second valve 38, and third valve 40 are also attached to gun body 12. First valve 36, second valve 38, and third valve 40 are biased towards being closed. In the illustrated embodiment, valves 36, 38, and 40 have springs that force them closed when valve actuator 14 is not forcing them open. First valve stem 42 is slidably connected to first valve 36, second valve stem 44 is slidably connected to second valve 38, and third valve stem 46 is slidably connected to third valve 40. Second valve stem 44 and third valve stem 46 are substantially parallel to first valve stem 42. Furthermore, valve stems 42, 44, and 46 are substantially coplanar along their respective lengths. In the illustrated embodiment, first valve stem 42, second valve stem 44, and third valve stem 46 each has a round portion that emerges from the respective valves 36, 38, and 40. The remaining portion of each valve stem 42, 44, and 46 has two parallel flats instead of being completely round.

Lower actuator portion 50 has first stem slot 60, second stem slot 62, third stem slot 64 and lower actuator holes 58A-58D that are threaded and substantially orthogonal to stem slots 60, 62, and 64. Lower actuator portion 50 is positioned in contact with first valve stem 42, second valve stem 44, and third valve stem 46. Specifically, first valve stem 42 is positioned in and substantially parallel to first stem slot 60 of lower actuator portion 50. Second valve stem 44 is positioned in and substantially parallel to second stem slot 62 of lower actuator portion 50. Third valve stem 46 is positioned in substantially parallel to third stem slot 64 of lower actuator portion 50. Therefore, each of first stem slot 60, second stem slot 62, and third stem slot 64 is configured to have a flat bottom with curved sides to correspond with the shapes of valve stems 42, 44, and 46.

Upper actuator portion 48 has set screw hole 54A on one side and set screw hole 54B on the opposite side. Set screw 52A is positioned coaxially with set screw hole 54A and set screw 52B is positioned coaxially with set screw hole 54B. Upper actuator portion 48 also has upper actuator holes 57A-57D that are substantially orthogonal to set screw holes 54A-54B. Each one of actuator screws 56A-56D is positioned in one of upper actuator holes 57A-57D, respectively. In the illustrated exploded view, upper actuator portion 48 is positioned above lower actuator portion 50. Specifically, upper actuator portion 48 is positioned such that upper actuator holes 57A-57D are coaxial with lower actuator holes 58A-58D, respectively.

Assembly valve actuator 14 is accomplished by positioning lower actuator portion 50 against first valve stem 42, second valve stem 44, and third valve stem 46 (as shown in FIG. 4). Then upper actuator portion 48 in positioned into contact with lower actuator portion 50, with a portion of pin shafts 33A-33B and pin balls 35A-35B being slidably positioned within set screw holes 54A-54B, respectively. Upper actuator portion 48 is then positioned such that upper actuator holes 57A-57D are coaxial with lower actuator holes 58A-58D, respectively. Actuator screws 56A-56D are threaded into lower actuator holes 58A-58D, respectively, and tightened. In the embodiment shown in FIG. 4, valve stems 42, 44 and 46 are slightly taller than the depths of slots 60, 62 and 64. When upper actuator portion 48 is attached to lower actuator portion 50 at interface surfaces forming slots 60, 62 and 64, valve stems 42, 44, and 46 are clamped between upper actuator portion 48 and lower actuator portion 50 by valve actuator 14. In other embodiments, slots 60, 62 and 64 can be formed in upper actuator portion 48, or can be formed partially from upper actuator portion 48 and partially from lower actuator portion 50.

Assembly of valve actuator 14 is continued by threading set screws 52A-52B into set screw holes 54A-54B, respectively. Set screws 52A-52B are inserted until they contact pin balls 35A-35B, respectively. Set screws 52A-52B can be used to adjust the point of contact between valve actuator 14 and push pins 31A-31B, respectively. This can be done, for example, to alleviate dimensional tolerance issues between trigger 18, push pins 31A-31B, and upper actuator portion 48. In an alternative embodiment, set screws 52A-52B can be positioned as to not be in contact with pin balls 35A-35B, respectively. However, in such an embodiment, set screw 52A is attached to upper actuator portion 48 at substantially the same distance from pin ball 35A as set screw 52B is from pin ball 35B.

In the illustrated embodiment, when valve actuator 14 is assembled, the interface between upper actuator portion 48 and lower actuator portion 50 is substantially parallel to valve stems 42, 44, and 46. In addition, push pins 31A-31B are substantially parallel to valve stems 42, 44, and 46, but the pivot axis of trigger 18 (i.e. the axis between trigger pivots 30A-30B) is substantially orthogonal to valve stems 42, 44, and 46. Furthermore, push pins 31A-31B and valve stems 42, 44, and 46 are substantially coplanar. This plane is thereby substantially parallel to the interface between upper actuator portion 48 and lower actuator portion 50. In addition, this plane is parallel to the pivot axis of trigger 18.

As stated previously when trigger 18 is pulled, force is transmitted from trigger arms 18A-18B to pin heads 32A-32B, through push pins 31A-31B to set screws 52A-52B at pin balls 35A-35B, respectively. Such force moves valve actuator 14 axially away from gun body 12 along push pins 31A-31B. Such movement is parallel to first valve stem 42, second valve stem 44, and third valve stem 46. Because valve actuator 14 is clamped on to valve stems 42, 44, and 46; first valve 36, second valve 38, and third valve 40 are opened. Because valve actuator was clamped on to valve stems 42, 44, and 46 when valves 36, 38, and 40 were closed; valves 36, 38, and 40 are all opened the same amount. Specifically, valves 36, 38, and 40 are opened simultaneously, and valve stems 42, 44, and 46 are displaced the same distance. This allows for first component C1, second component C2, and fluid F to be dispensed from dispensing gun 10. As such, valve actuator 14 eliminates lead and lag in the opening of valves 36, 38 and 40. When trigger 18 is released, force is no longer exerted on valve actuator 14. Because valves 36, 38, and 40 are biased towards being closed, valve stems 42, 44, and 46 pull valve actuator in towards gun body as valves 36, 38, and 40 close. As with opening, valves 36, 38, and 40 all close simultaneously. Thus, in embodiments where first valve 36, second valve 38 and third valve 40 have the same discharge profiled, the same dispensing ratio is maintained throughout the stroke of trigger 18.

Because of the attachment positions of set screws 52A-52B, the force from trigger 18 is evenly distributed to both sides of valve actuator 14. However, in an alternative embodiment, set screws 52A-52B are not in contact with push pins 31A-31B when trigger 18 is forward. In that arrangement, there will be some free movement of trigger 18 prior to valve actuator 14 being moved, but once trigger 18 is moved a sufficient amount, push pins 31A-31B will contact set screws 52A-52B simultaneously, respectively. That is because set screws 52A-52B are spaced substantially equidistantly from pin balls 35A-35B, respectively. Therefore, the dispensing of first component C1, second component C2, and fluid F will occur in the same ratios as in the illustrated embodiment.

The components and configuration of gun body 12 and valve actuator 14 as shown in FIG. 4 allow for a precise dispense ratio of first component C1 to second component C2 that can be maintained independent of how far trigger 18 is pulled (given proper valve construction and material control, for example, proper first component C1 and second component C2 pressurization). Likewise, the precise dispense ratio of component to fluid F can be maintained given that third valve 40 is opened the same amount as first valve 36 and second valve 38. Furthermore, valve actuator 14 can be detached and reattached without interfering with this ratio. That is because valves 36, 38, and 40 are closed when valve actuator 14 is detached, and valves 36, 38, and 40 will be closed when valve actuator 14 is reattached. In addition, because valve actuator 14 moves valve stems 42, 44, and 46 simultaneously, the precise position of valve actuator 14 on valve stems 42, 44, and 46 is inconsequential as long as valve actuator 14 has enough of a grip on valve stems 42, 44, and 46 to open valves 36, 38, and 40. This is because set screw 52A is the same distance from push pin 31A as set screw 52B is from push pin 31B, allowing for simultaneous and equidistant movement of both sides of valve actuator 14.

Depicted in FIG. 4 is one embodiment of the present invention, to which there are alternative embodiments. For example, stem slots 60, 62, and 64 in lower actuator portion 50 can be of a different but still corresponding shape from valve stems 42, 44, and 46. Specifically, stem slots 60, 62, and 64 can be rectangular in shape if valve stems 42, 44, and 46 are as depicted in FIG. 4. In another example, valve stems 42, 44, and 46 can be completely round or have a round portion and a rectangular portion. In such an embodiment, stem slots 60, 62, and 64 are configured to correspond with valve stems 42, 44, and 46. For a further example, valve actuator 14 can be assembled such that upper actuator portion 48 and lower actuator portion 50 are attached by partially threading at least one of actuator screws 56A-56D into at least one of the respective lower actuator holes 58A-58D. Then the partially assembled valve actuator 14 can be slid on to valve stems 42, 44, and 46 prior to completely tightening all of actuator screws 56A-56D.

It should be recognized that the present invention provides numerous benefits and advantages. For example, once dispensing gun 10 has been assembled and set screws 52A-52B have been properly adjusted, disassembly and reassembly of valve actuator 14 requires no adjustment in order to maintain the proper dispense ratios.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A dispensing gun comprising:

a gun body;

a first component inlet attached to the gun body for receiving a first component;

a second component inlet attached to the gun body for receiving a second component;

a dispense head for dispensing the first and second components from the dispensing gun;

a first valve attached to the gun body having a first valve stem for controlling flow of the first component to the dispense head;

a second valve attached to the gun body having a second valve stem for controlling flow of the second component to the dispense head, with the second valve stem being parallel to the first valve stem;

a clamp having a first portion and a second portion, wherein the first valve stem and the second valve stem are positioned in between the first portion and the second portion, with the first portion being attached to the second portion such that the first valve stem and the second valve stem move with movement of the clamp in a direction parallel to the axes of the valve stems; and a trigger rotatably attached to the gun body for controlling movement of the clamp.

2. The dispensing gun of claim 1, and further comprising:

a third valve attached to the gun body having a third valve stem for controlling dispensing of a pressurized fluid, with the third valve stem being parallel to the first valve stem, wherein the third valve stem is positioned between the first portion and the second portion of the clamp such that the third valve stem moves with movement of the clamp.

3. The dispensing gun of claim 1, wherein movement of the clamp in one direction opens both the first and second valves.

4. The dispensing gun of claim 3, wherein the first and second valves are opened the same amount.

5. The valve actuation system of claim 1, wherein a portion of the first valve stem and a portion of the second valve stem are of a four-sided shape that is substantially flat on two opposite sides and substantially rounded on two opposite sides.

6. The valve actuation system of claim 1, wherein the clamp includes first and second valve stem slots extending between the first portion and the second portion to receive the first valve stem and the second valve stem, respectively.

7. The dispensing gun of claim 1, wherein the first portion and the second portion of the clamp are attached with a threaded fastener.

8. The dispensing gun of claim 1, and further comprising:

a plurality of parallel push pins slidably positioned in the gun body that are parallel to the first and second valve stems, each of the plurality of push pins being in contact with a cam surface of the trigger at a first end and in contact with the clamp at a second end.

9. The dispensing gun of claim 8, wherein the first and second valve stems and the plurality of push pins are coplanar.

10. The dispensing gun of claim 9, wherein the clamp has a plurality of set screws for adjusting points of contact between the plurality of push pins and the clamp.

11. A valve assembly comprising:

a first valve having a first valve stem for controlling dispensing of a first component;

a second valve having a second valve stem for controlling dispensing of a second component, where the second valve stem is parallel to the first valve stem; and a valve actuator clamped to the first and second valve stems to open the first and second valves by jointly moving the first and second valve stems, the valve actuator including:

a first slot for attaching the valve actuator to the first valve stem, the first slot having a corresponding shape to the first valve stem and being parallel to the first valve stem; and a second slot for attaching the valve actuator to the second valve stem, the second slot having a corresponding shape to the second valve stem and being parallel to the second valve stem;

a first hole that is located near a first side of the valve actuator for receiving a first set screw, the first hole being parallel to the first valve stem; and a second hole that is located near a second side of the valve actuator, that is opposite the valve actuator from the first hole, the second hole for receiving a second set screw, the second hole being parallel to the first hole.

12. The valve assembly of claim 11, and further comprising:

a trigger that moves the valve actuator such that the first and second valve stems are displaced the same distance.

13. The valve assembly of claim 12, wherein the first valve and second valve are opened simultaneously by movement of the trigger.

14. The valve assembly of claim 12, wherein the trigger has a first cam that acts against a first push pin that contacts the first set screw and a second cam that acts against a second push pin that contacts the second set screw.

15. The valve assembly of claim 12, wherein the trigger moves by pivoting about an axis that is parallel to a plane defined by the lengths of the first and second valve stems.

16. The valve assembly of claim 11, wherein a portion of the first valve stem and a portion of the second valve stem are of a four-sided shape that is substantially flat on two opposite sides and substantially rounded on two opposite sides.

17. The valve assembly of claim 11, wherein the valve actuator comprise an upper portion and a lower portion secured together by threaded fasteners at interface surfaces forming the first slot and the second slot.

18. A valve assembly comprising:

a trigger with a first cam and a second cam;

a first valve having a first valve stem for controlling the dispensing of a first component;

a second valve having a second valve stem that is parallel to the first valve stem, for controlling the dispensing of a second component;

a valve actuator having:

a first portion having a first slot for the first valve stem and a second slot for the second valve stem; and a second portion that is attached to the first portion that clamps the first valve stem in the first slot and the second valve stem in the second slot;

a first push pin that contacts the first cam and the valve actuator, the first push pin being parallel to the first valve stem;

a second push pin that contacts the second cam and the valve actuator, the second push pin being parallel to the first push pin.

19. The valve assembly of claim 18, wherein the first valve stem, second valve stem, first slot, second slot, first push pin, and second push pin are coplanar.

20. The valve assembly of claim 19, wherein an interface between the first and second portions of the valve actuator is a plane that is parallel to the plane formed by the lengths of the first and second valve stems.

* * * * *